US006098705A

United States Patent [19]

Kim

[11] Patent Number: 6,098,705

[45] Date of Patent: Aug. 8, 2000

[54] COIL TYPE CONDENSER FOR REFRIGERATOR

[75] Inventor: Byeong-Sun Kim, Seoul, Rep. of Korea

[73] Assignee: Daewoo Electronics Co., Ltd., Seoul, Rep. of Korea

[21] Appl. No.: 09/156,658

[22] Filed: Sep. 18, 1998

[30] Foreign Application Priority Data

Jun. 30, 1998 [KR] Rep. of Korea ..... 98-26247

[51] Int. Cl.[7] ..... F28F 1/00

[52] U.S. Cl. ..... 165/163; 165/DIG. 496; 165/906

[58] Field of Search ..... 62/454, 455, 456; 165/163

[56] References Cited

U.S. PATENT DOCUMENTS

| | | | |
|---|---|---|---|
| 784,373 | 3/1905 | Allen | 165/163 |
| 1,708,625 | 4/1929 | Livingston | 62/455 X |
| 1,801,563 | 4/1931 | Muffly | 62/455 |
| 1,850,527 | 3/1932 | Allyne | 62/456 X |
| 1,985,950 | 1/1935 | Resek et al. | 165/163 X |
| 2,203,439 | 6/1940 | Oliver | 62/455 X |
| 2,657,020 | 10/1953 | Hofmeister | 165/163 X |
| 4,073,045 | 2/1978 | Margen et al. | 165/172 X |
| 5,159,976 | 11/1992 | Virtue . | |
| 5,832,739 | 11/1998 | Bacchus | 62/310 |

*Primary Examiner*—Allen Flanigan

*Attorney, Agent, or Firm*—Smith, Gambrell & Russell, LLP; Beveridge, DeGrandi, Weilacher & Young Intellectual Property Group

[57] ABSTRACT

A coil type condenser for a refrigerator holds a flow of air which cools the condenser by securing a condenser length enough to radiate heat and simultaneously holding enough pitch. In the coil type condenser, a pipe is wound spirally to face a blowing direction of cool air generated by a cooling fan of the refrigerator. The pipe includes a plurality of coils formed integrally each having upper and lower horizontal portions and left and right vertical sides, each of even numbered coils of the coils having a size different from that of each of odd numbered coils thereof. A support member welded to the pipe supporting the pipe. According to the condenser, since pitches between coils forming the coil type condenser are short, a suitable coil length of the condenser can be maintained in a narrow space. Thus, the coil type condenser can prevent an excessive pressure from generating when a compressor initially operates and can used for a small or medium refrigerator.

2 Claims, 12 Drawing Sheets

FIG.9

| PARAMETER | | COVENTIONAL CONDENSER | EXAMPLE 1 | EXAMPLE 2 |
|---|---|---|---|---|
| CONDENSER SPECIFICATION | PITCH/ ROTATIONAL NUMBER | 6.5mm/34times | 8.0mm/30times | 10.0mm/23times |
| | LENGTH | 20.56m | 18.17m | 13.98m |
| REFRIGERANT AMOUNT | | 200g | 200g | 180g |
| COOLING SPEED | FREEZER COMPARTMENT | 90.8min | 79min | 77min |
| | REFRIGERATING COMPARTMENT | 118min | 114.8min | 118min |
| MONTHLY SPENDING POWER | | 56.7kWh | 54.5kWh | 54.8kWh |

FIG. 10

| PARAMETER | COMPRESSOR PRESSURE | TEMPERATURE WITHIN REFRIGERATOR | | | |
|---|---|---|---|---|---|
| | | FREEZER COMPARTMENT | REFRIGERATING COMPARTMENT | CONDENSER ENTRANCE | CONDENSER EXIT |
| PITCH 6.5mm | 15.5 kg/cm$^2$ | −26.8°C | −16.7°C | 44.2°C | 42.5°C |
| PITCH 8.0mm | 16.9 kg/cm$^2$ | −27.0°C | −16.2°C | 44.5°C | 43.2°C |
| PITCH 10.0mm | 15.7 kg/cm$^2$ | −27.0°C | −16.9°C | 43.3°C | 43.5°C |

COIL TYPE CONDENSER FOR REFRIGERATOR

BACKGROUND OF THE INVENTION

1. Field of the Invention

The present invention relates to a refrigerator, and more particularly, to a coil-type condenser for a refrigerator having a minimum pitch between coils.

2. Prior Art

A condenser is a radiant pipe which is used for air conditioners and a refrigerators, and radiates high heat from a gaseous refringent by converting it into a liquefied refringent. Examples of condensers which can be mounted at a narrow space such as a machine chamber of a refrigerator are a bank-type condenser and a coil-type condenser. The bank-type condenser is a rectangular condenser which is traversely arranged, while the coil-type condenser is a condenser which is wound spirally in a rectangular or round shape.

In the coil type condenser, by holding the interval (pitch) between coils by more than a predetermined distance, manufacturing cost is lowered which improving condenser. The coil-type condenser is easily mounted on a large refrigerator having a large machine chamber. In a medium refrigerator, a total length of the coil type condenser becomes short in a proper pitch. Accordingly, when the condenser is activated, condensed pressure increases excessively and causes undesirable noise in the compressor. Thus, the coil type condenser has not been used for the medium refrigerator. The refrigerating performance of a refrigerator is influenced by the radiant capacity of a condenser. Different types of condensers which improve the radiant capacity of a condenser in order to increase the refrigerating efficiency of a refrigerator are disclosed in the prior arts.

U.S. Pat. No. 5,159,976, (issued to Michael D. Virtue et al. on Nov. 3, 1992) discloses an energy efficient forced draft condenser utilizing a series of helical tube coils with the tube having a lateral fin thereon.

FIG. 1 shows a conventional seamless condenser for a refrigerator. The seamless condenser 100 includes a seamless pipe 102 having a multiple row and column shape and a plurality of support members 104 supports the seamless pipe 102 so that the pipe can secure an enough length to radiate heat. FIG. 2 shows a conventional rectangular condenser for a refrigerator. A pipe 202 is arranged in a multistage of at least two rows so that the pipe 202 can secure an enough length to radiate heat. A plurality of radiant fins 204 are installed at both sides of the pipe 202 and increase a radiant area of the pipe 202. FIG. 3 shows a conventional elliptical condenser 300 for a refrigerator. A rectangular pipe 302 is spirally wound in one direction to have enough radiant length. A radiant fin 304 is disposed between pipes and enlarges a radiant area of the rectangular pipe 302. A cooling fan 306 is disposed adjacent to the radiant fin 304.

Since the seamless pipe 102 shown in FIG. 1 or the pipe 202 is arranged in a multiple row and column or a multistage, and although the pipe 102 or the seamless pipe 202 can secure an enough length to radiate heat, the pipe 102 or 202 is wound in such a manner that each pipe is formed near to an adjacent pipe. Accordingly, air for cooling the condenser cannot smoothly be ventilated thus decreasing radiant performance. Although an elliptical condenser 300 shown in FIG. 3 can secure a length enough to radiate heat, an area in which a refrigerant passes is so wide that a great deal of high refrigerant gas is emitted from a compressor before liquefaction. Accordingly, cooling performance of the conventional elliptical condenser 300 is significantly lower than that of the circle condenser.

FIG. 4 is an end view for showing a pitch of the conventional condenser shown in FIG. 1, FIG. 2, or FIG. 3. In the conventional condenser, the pitch l1 between coils should have longer than a predetermined distance. Thus a suitable condenser length cannot have a narrow space in order to be suitable for a small or medium refrigerator. In the flow of cool air which cools the conventional condenser, since the cool air generated by a cooling fan 402 is blown according to R, the narrower the pitch interval, the more the refrigerating performance with respect to unit length of a coil of the condenser drops.

SUMMARY OF THE INVENTION

Therefore, it is an object of the present invention, for the purpose of solving the above mentioned problems, to provide a coil type condenser for a refrigerator capable of holding a flow of an air which cools the condenser by securing a condenser length enough to radiate heat and simultaneously hold enough pitch.

In order to attain the object, according to the present invention, there is provided a condenser for refrigerator, said condenser comprising:

a pipe wound spirally to face a blowing direction of cool air generated by a cooling fan of the refrigerator, the pipe including a plurality of coils formed integrally each having upper and lower horizontal portions and left and right vertical sides, each of even numbered coils of the coils having a size different from that of each of odd numbered coils thereof; and a support member welded to the pipe for supporting the pipe.

Also, there is provided a condenser for refrigerator, said condenser comprising:

a pipe wound spirally facing a blowing direction of cool air generated by a cooling fan of the refrigerator, the pipe including a plurality of coils formed integrally, the plurality of coils having odd numbered circle coils arranged on the same line and even numbered circle coils arranged on a line different from the odd numbered circle coils, the odd and even number circle coils being integrally formed; and a support member welded to the pipe for supporting the pipe so that the odd and even numbered coils are disposed on the same plane at least one point.

According to the present invention since pitches between coils forms the coil type condenser is short, a suitable coil length of the condenser can be maintained in a narrow space.

Other objects and further features of the present invention will become apparent from the detailed description when read in conjunction with the attached drawings.

BRIEF DESCRIPTION OF THE DRAWINGS

Other features and advantages of the present invention will become more apparent from the following description taken in connection with the accompanying drawings, wherein:

FIG. 9 is a table which indicates one example of an experimental result for illustrating amount of refrigerant, refrigerating performance, and monthly spending power according to a pitch of the condenser shown in FIG. 7;

FIG. 10 is a table which indicates a full down testing result as one example of an experimental result for illustrating an initial pressure of the compressor when the compressor operates according to a setting length of the coil type condenser shown in FIG. 7 and a noise state of the refrigerator by a high frequency generated according to an initial pressure thereof;

DETAILED DESCRIPTION OF THE PREFERRED EMBODIMENT

Figure 1:
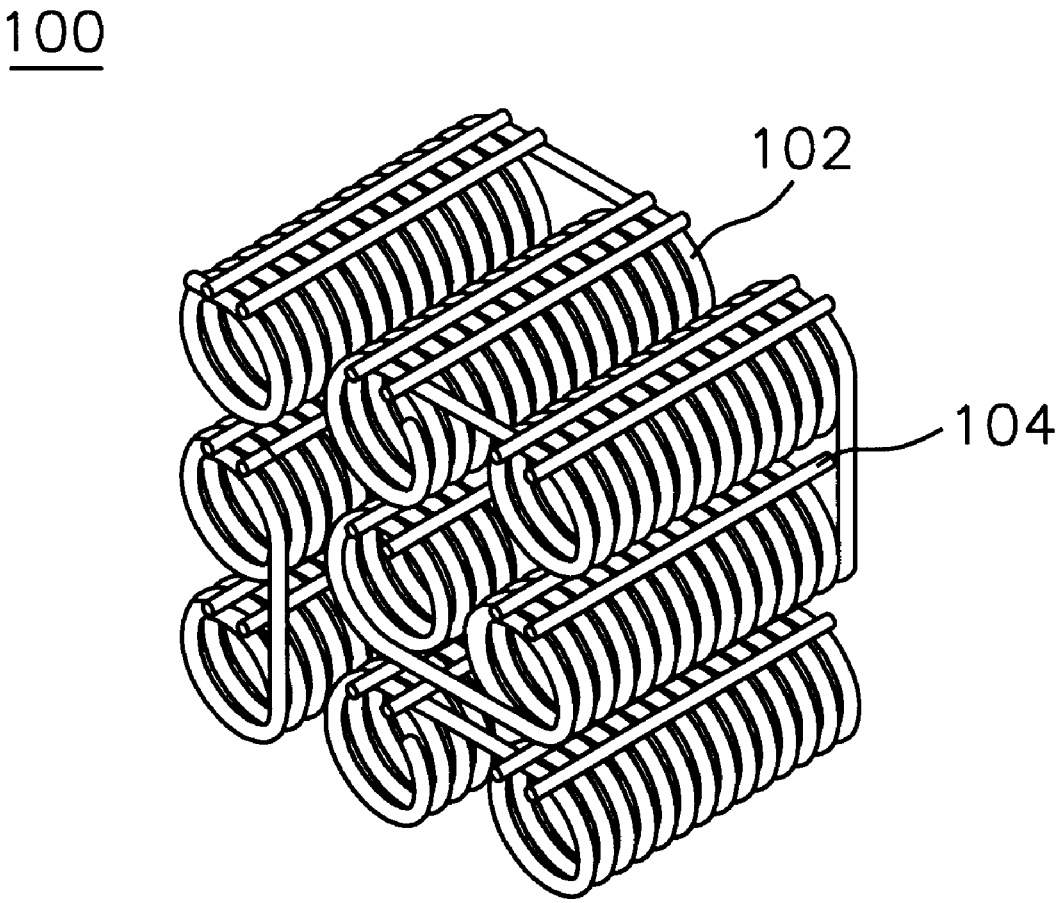
FIG. 1 PRIOR ART
FIG. 1 is a perspective view for showing a conventional seamless condenser for a refrigerator.
Figure 2:
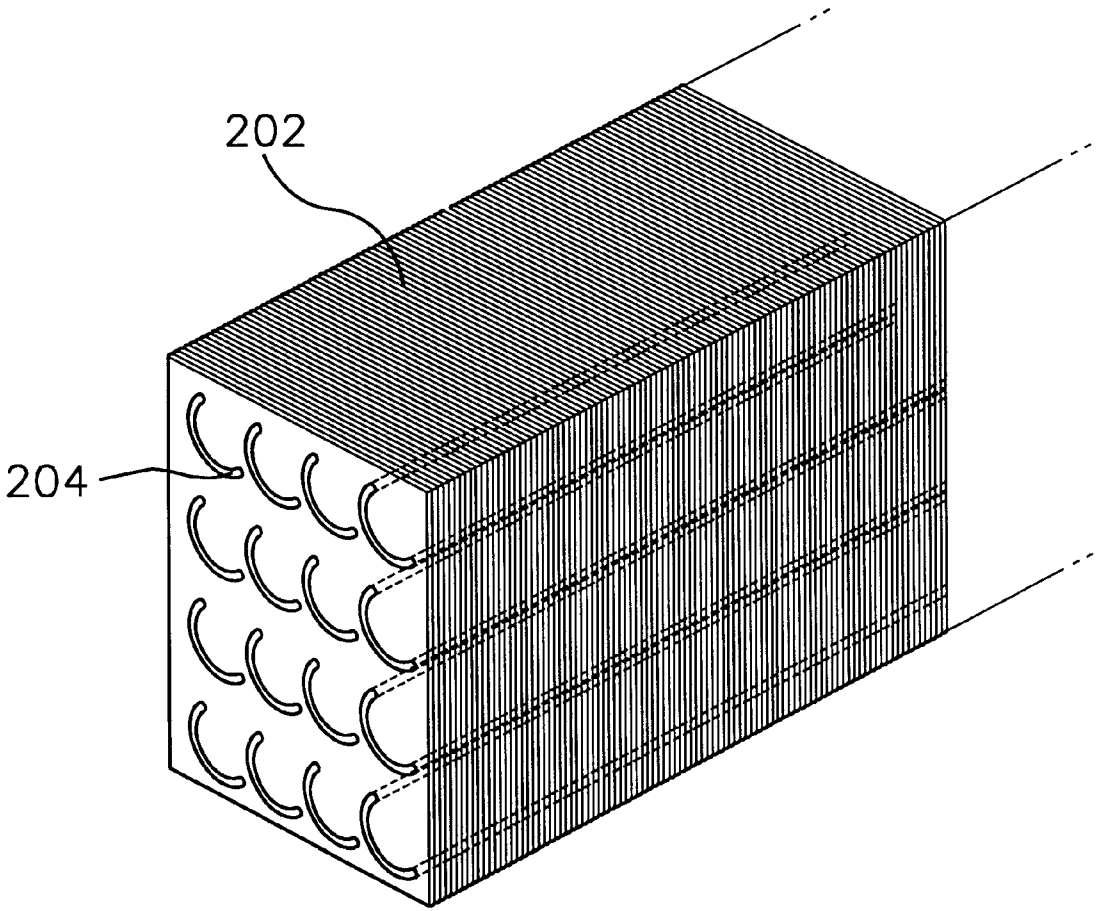
FIG.2 PRIOR ART
FIG. 2 is a perspective view for showing a conventional rectangular condenser for a refrigerator.
Figure 3:
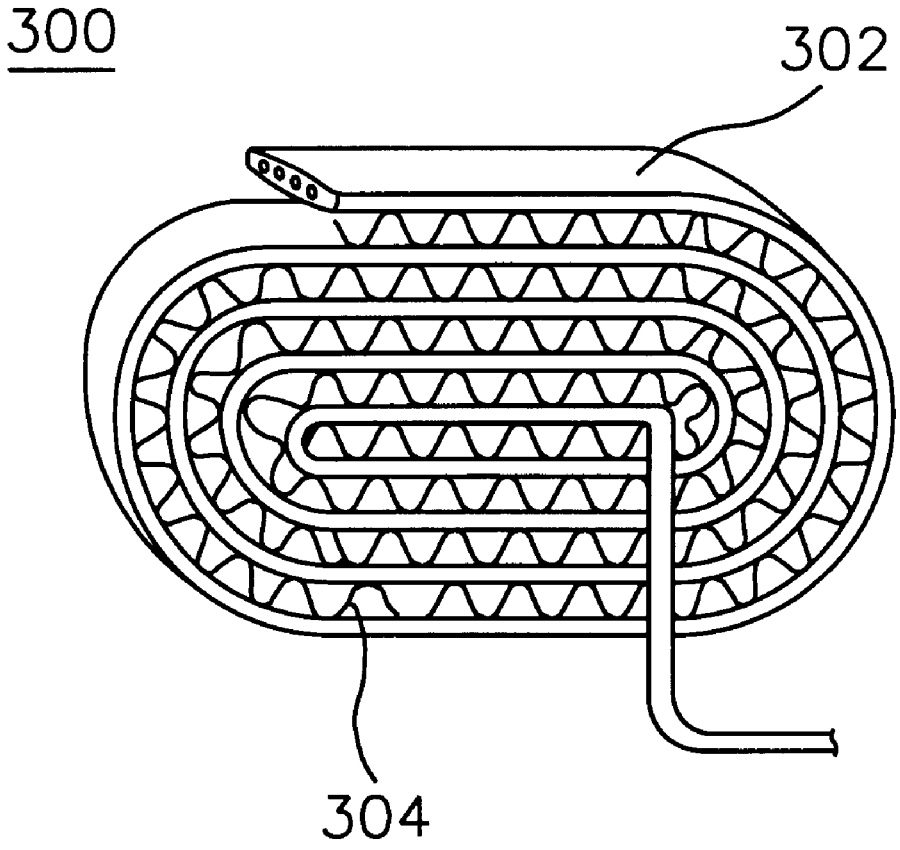
FIG. 3 PRIOR ART
FIG. 3 is a perspective view for showing a conventional elliptical condenser for a refrigerator.
Figure 4:
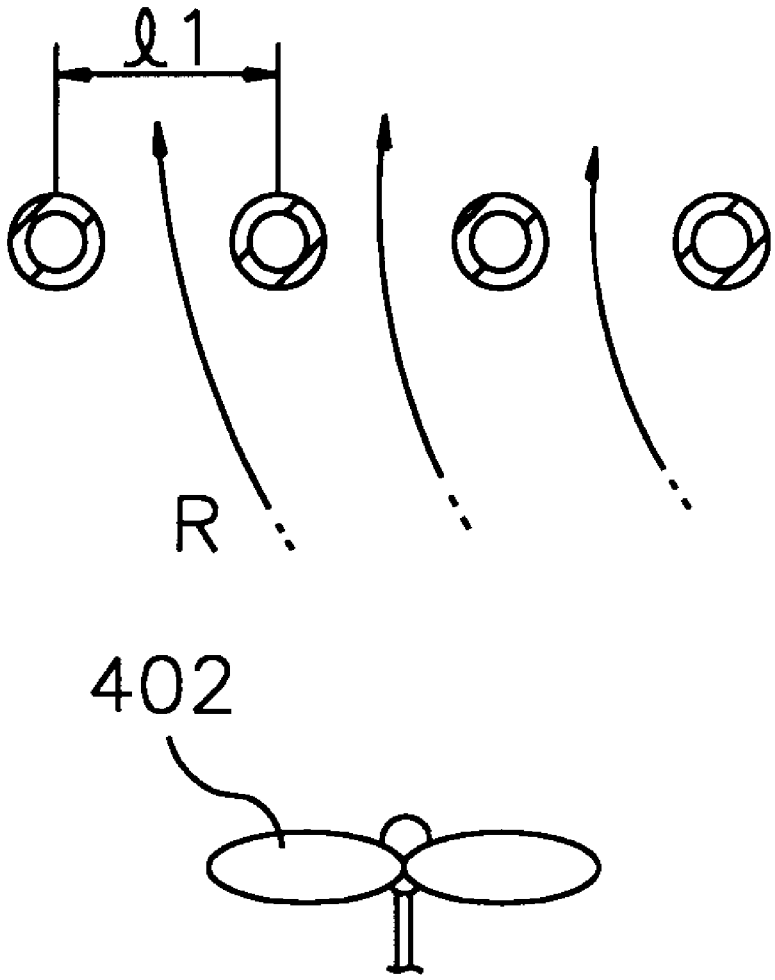
FIG. 4 is an end view for showing a pitch of the conventional condenser shown in FIG. 1, FIG. 2, or FIG. 3.
Figure 5:
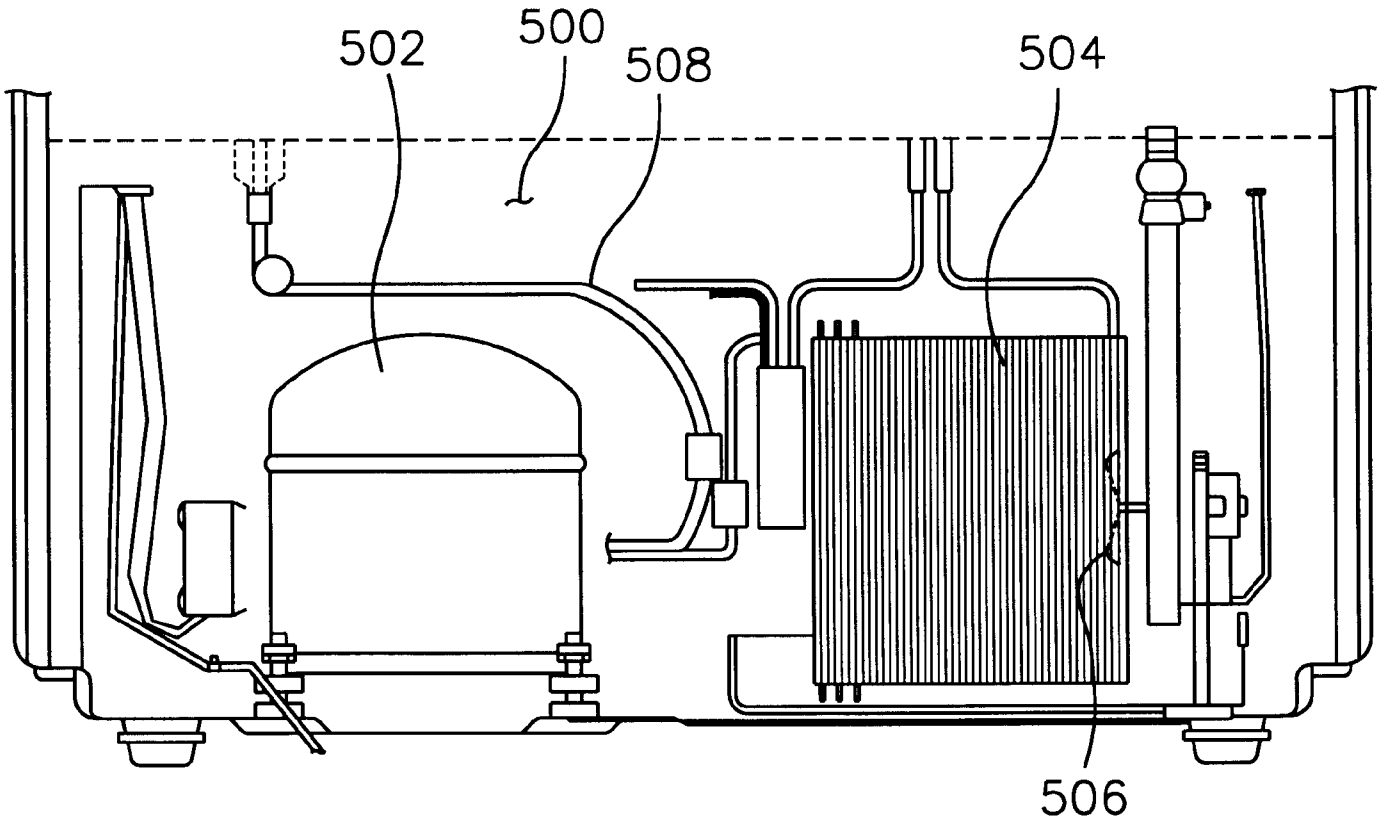
FIG. 5 is a view for showing a state that a coil type condenser according to the present invention is mounted in a machine chamber.

The preferred embodiment of the present invention will hereinafter be described in detail with reference to the accompanying drawings. FIG. 5 shows a state that a coil-type condenser according to the present invention is mounted in a machine chamber 500. In the machine chamber 500, a compressor 502, a coil type condenser 504, a cooling fan 506, and a refrigerant pipe 508 are mounted. The compressor 502 compresses charged refrigerant into a high temperature and pressure. The coil-type condenser 504 is spirally wound to have a predetermined diameter and is apart from the compressor 502 by a predetermined distance.

A plurality of coils are formed in the coil type condenser 504, each having a predetermined pitch between adjacent coils. The pitch between the coils needs a distance of extent which cool air generated in the machine chamber 400 by means of the rotation of the cooling fan 506 can easily pass between the coils. In order to maintain optimal radiant performance, a pitch of more than 10 mm is needed.

The cooling fan 506 is mounted in the coil type condenser 504 and is electrically connected to the compressor 502. When the compressor 502 operates, simultaneously the cooling fan 506 operates to cool the coil type condenser 504. And when the compressor 502 stops, the cooling fan 506 stops. The cooling fan 506 is fixed within the condenser 504 and blows cool air generated by the rotation of the cooling fan 506 through the coil type condenser 504 into the compressor 502. The cool air blown by cooling fan 506 cools heat of about 40° C. radiated from the compressor 502, and the cooling fan 506 blows the air having heat of about 40° C. into the compressor 502 which radiates heat of 90–100° C. to cool it. The refrigerant pipe 508 connects the components with one another.

Figure 6:
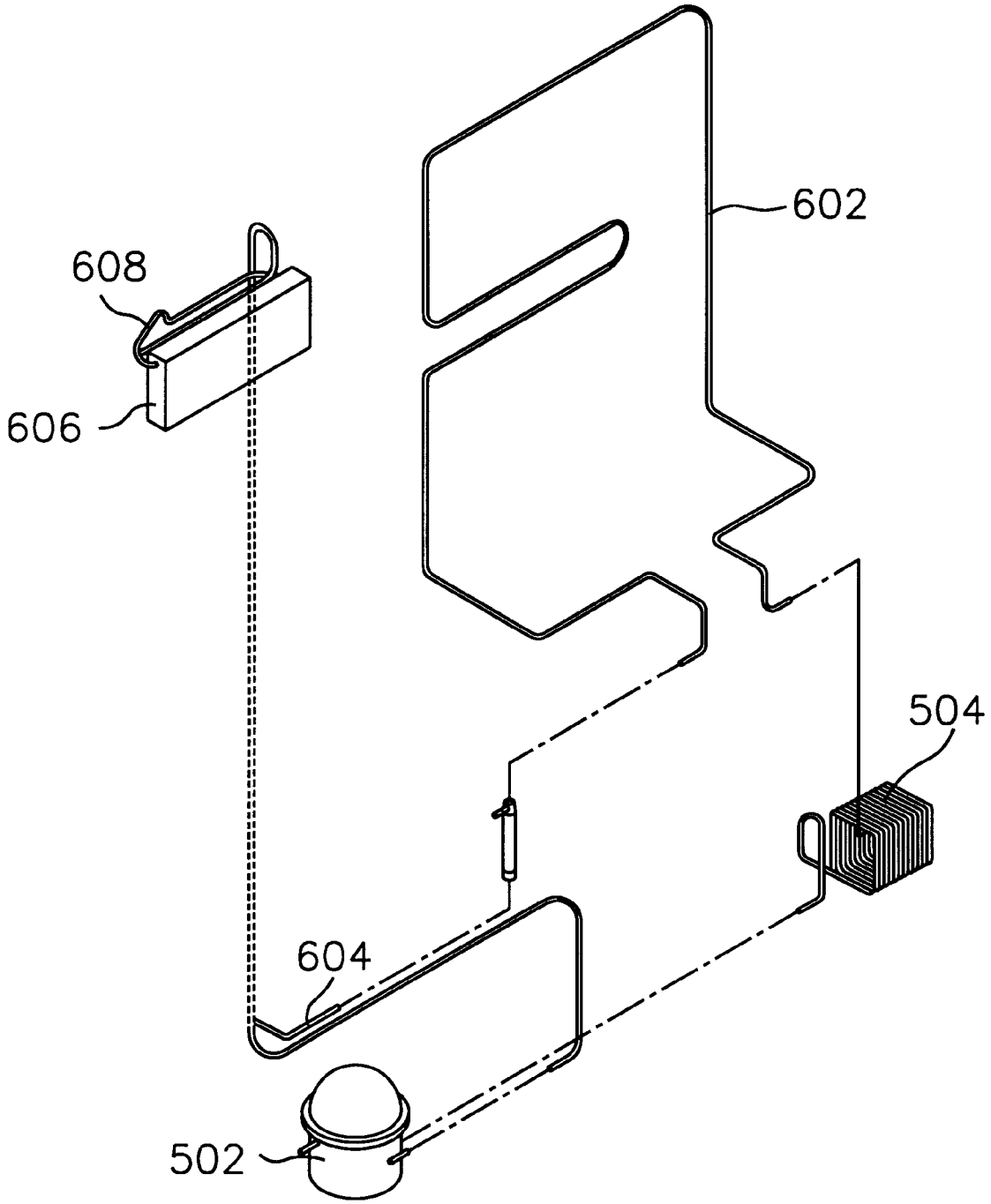
FIG. 6 is a schematic illustration for showing a cooling system of a refrigerator including the coil type condenser according to the present invention.

FIG. 6 shows a state that a cooling system of a refrigerator including the coil type condenser according to the present invention. The cooling system of a refrigerator includes a compressor 502, a coil type condenser 504, a hot pipe 602, a capillary tube 604, an evaporator 606, and an accumulator 608. The hot pipe 602 outwardly extends from one part of the coil type condenser 604 and is installed through all parts of the refrigerator. The hot pipe 602 prevents dew from being generated in a location where cool air within the refrigerator and hot air outside the refrigerator meet.

In the cooling system of the refrigerator, since evaporative performance of the evaporator 606 depends on radiating performance of the coil type condenser 504, the refrigerating capacity of the refrigerator is influenced directly by the radiant performance of the coil type condenser 504.

EMBODIMENT 1

Figure 7:
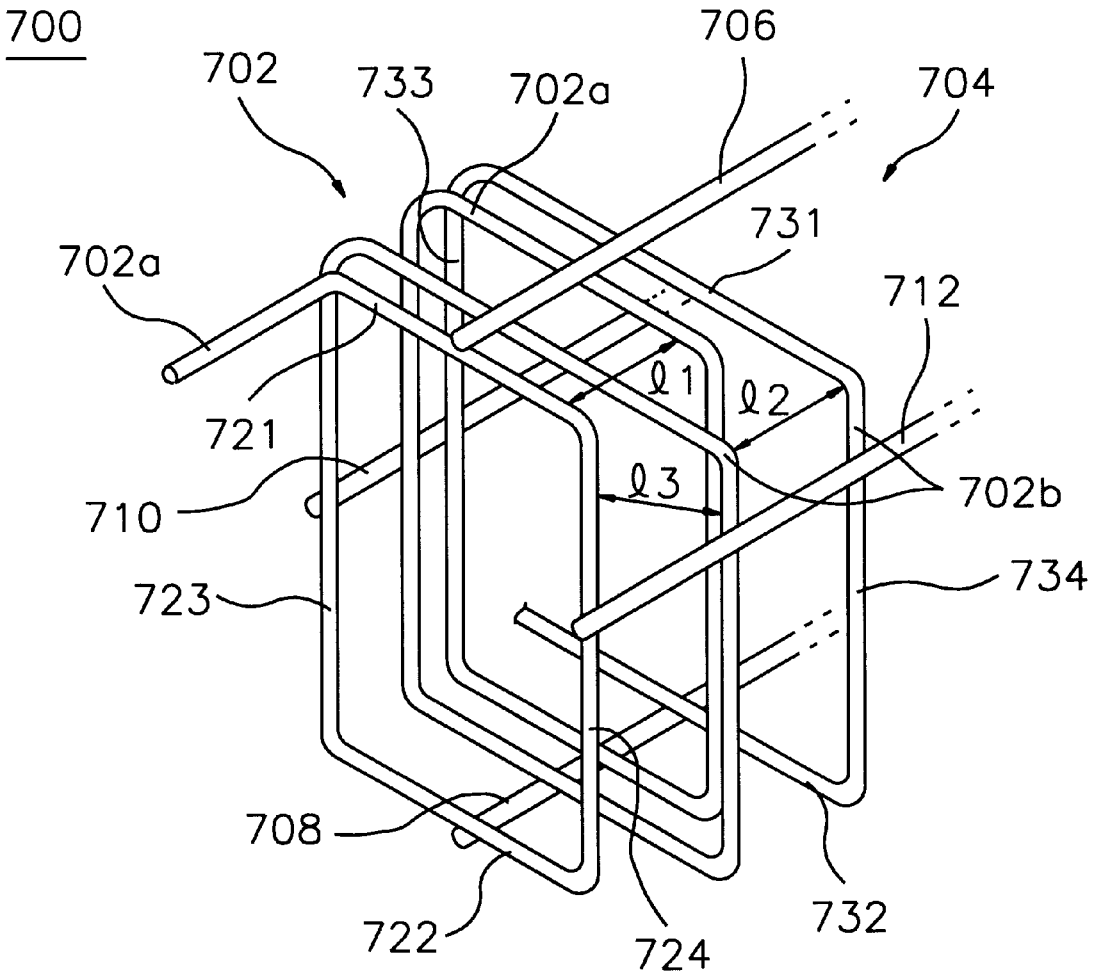
FIG. 7 is a perspective view for showing the coil type condenser for a refrigerator according to a first embodiment of the present invention.

FIG. 7 shows a coil type condenser 700 for a refrigerator according to a first embodiment of the present invention. The coil type condenser 700 includes a pipe 702 and a support member 704. The pipe 702 is wound spirally to face a blowing direction of cool air generated by a cooling fan 506 of the refrigerator. The pipe 702 includes a plurality of coils having odd and even numbered coils 702*a* and 702*b* formed integrally.

Each of the odd numbered coils 702*a* has upper and lower horizontal portions 721 and 722 and left and right vertical portions 723 and 724. Each of the even numbered coils 702*b* has upper and lower horizontal portions 731 and 732 and left and right vertical portions 733 and 734. Each of even numbered coils 702*b* has a size different from that of each of odd numbered coils 702*a*.

Each coil of the pipe 702 preferably has a rectangular shape. Lengths of the upper and lower horizontal portions of each of the odd numbered coils are preferably different from those of the upper and lower horizontal portions of each of the even numbered coils. Lengths of the left and right vertical portions of each of the odd numbered coils are preferably different from those of the left and right portions of each of the even numbered coils. A pitch l1 between the odd numbered coils 702*a* is preferably 8~12 mm, more preferably 10 mm. As same as in the odd numbered coils 702*a*, a pitch l2 between the even numbered coils 602*b* is preferably 8~12 mm, more preferably 10 mm. A pitch l3 between one of the odd numbered coils 602*a* and one of the even numbered coils 702*b* is preferably 8~12 mm, more preferably 10 mm.

The support member 704 is welded to the pipe 702 and supports the pipe 702. the support member 704 incudes a first support 706, a second support 708, a third support 710, and a fourth support 712. The first support 706 is welded to the upper horizontal portions 721 and 731 of the odd and even numbered coils 702*a* and 602*b* and supports the odd and even numbered coils 702*a* and 702*b* on a first same plane. The second support 708 is welded to the lower horizontal portion 722 of the odd numbered coils 702*a* and supports the odd numbered coils 702*a* on a second same plane. The third support 710 is welded to the left vertical portion 733 of the even numbered coils 702*b* and supports the even numbered coils 702*b* on a third same plane. The fourth support 712 is welded to the right vertical portion 734 Of the even numbered coils 702*b* and supports the even numbered coils 702*b* on a third same plane.

Figure 8:
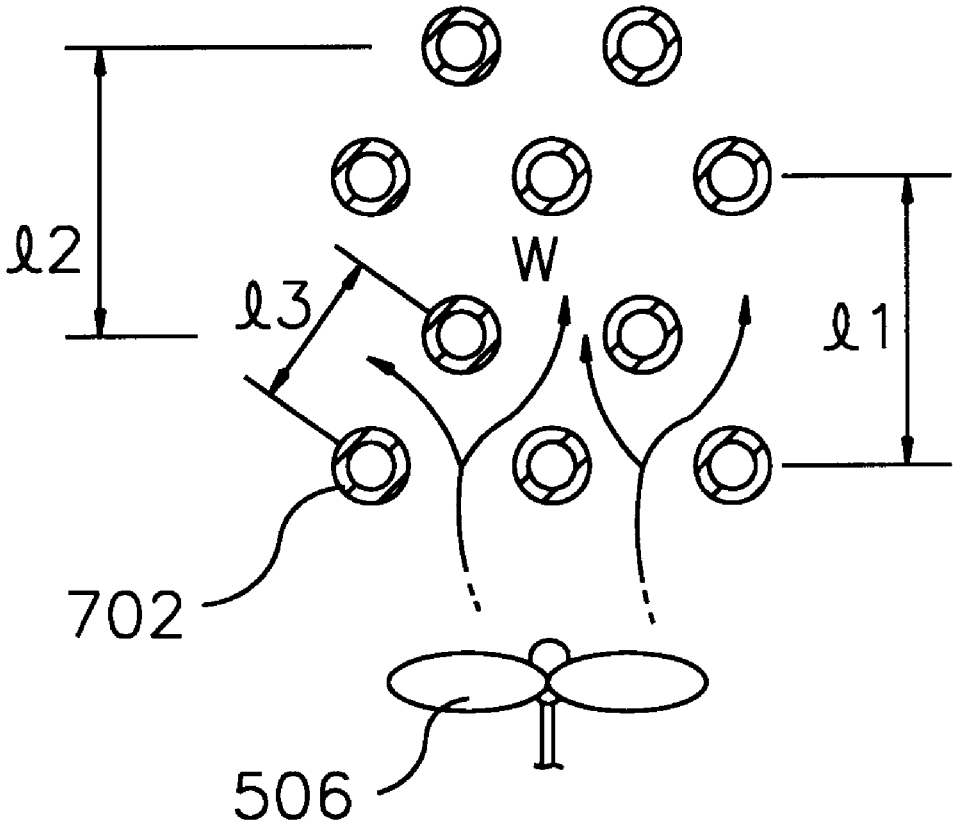
FIG. 8 is an end view for showing a pitch of the coil type condenser shown in FIG. 7.

FIG. 8 is an end view for showing a pitch of the coil type condenser 700 shown in FIG. 7. In a flow of cool air which cools the coil type condenser 700 shown in FIG. 7, since the cool air generated by a cooling fan 402 is blown between the odd numbered coils 602*a* and the even numbered coils 602*b* as shown by an arrow W in FIG. 8 to define an air flow of two directions and the pitch interval between coils of the coil type condenser 700 becomes longer than that of the conventional condenser, the flow of cool air is maintained smoothly thereby enhancing refrigerating performance.

FIG. 9 is a table which indicates an RT 30° C. basic performance test result, as one example of an experimental result for illustrating amount of refrigerant, refrigerating performance, and monthly spending power according to a pitch of the condenser. In the RT 30° C. basic performance test, an interval is established from the first time when temperatures in a freezer compartment and a refrigerating compartment reach 30° C. in a state that all power of the refrigerator is turned off, to the second time when the freezer and refrigerating compartments reach −5° C. and 10° C., respectively, after the power of the refrigerator is started. As known in the FIG. 9, the longer the pitch between the coils, the air which passes between the coils flows with more easiness. Even if a total length of the pipe is the same, a condenser having a longer pitch can achieve more refrigerating performance. However, when the pitch between pipe members is longer than a constant length, how much longer the pitch is, the radiant performance of the condenser is almost constant. When the pitch between coils of the condenser has a suitable length, how much shorter the length of the condenser is, good refrigerating performance can be achieved.

As illustrated in FIG. 9, when a pitch between pipe members of a conventional condenser has 6.5 mm pitch, is wound by thirty three times, and has 20.56 mm length, cooling speeds within the freezer compartment and refrigerating compartment are 90.8 minutes and 118 minutes, respectively. When a pitch between pipe members of a second example of a coil type condenser according to the present invention has 10.0 mm pitch, is wound by twenty three times, and has 13.98 mm length, cooling speeds within the freezer compartment and refrigerating compartment are 77 minutes and 118 minutes, respectively.

FIG. 10 is a table which indicates a full down testing result as one example of an experimental result for illustrating an initial pressure of the compressor 402, when the compressor 402 operates according to a setting length of the condenser and a noise state of the refrigerator by a high frequency generated according to the initial pressure thereof. The full down testing result indicates a result which checks temperatures when the temperatures in a freezer compartment and a refrigerating compartment reach the lowest value after the power of a refrigerator is all turned on. Initial pressures of the compressor 402 are all measured according to the pitch between coils of the condenser when the compressor 402 operates. The initial pressure of the compressor 402 at the operation of the compressor 402 is related to an undesirable noise of the refrigerator. Accordingly, a condenser of a suitable length prevents the refrigerator from generating noise.

EMBODIMENT 2

Figure 11:
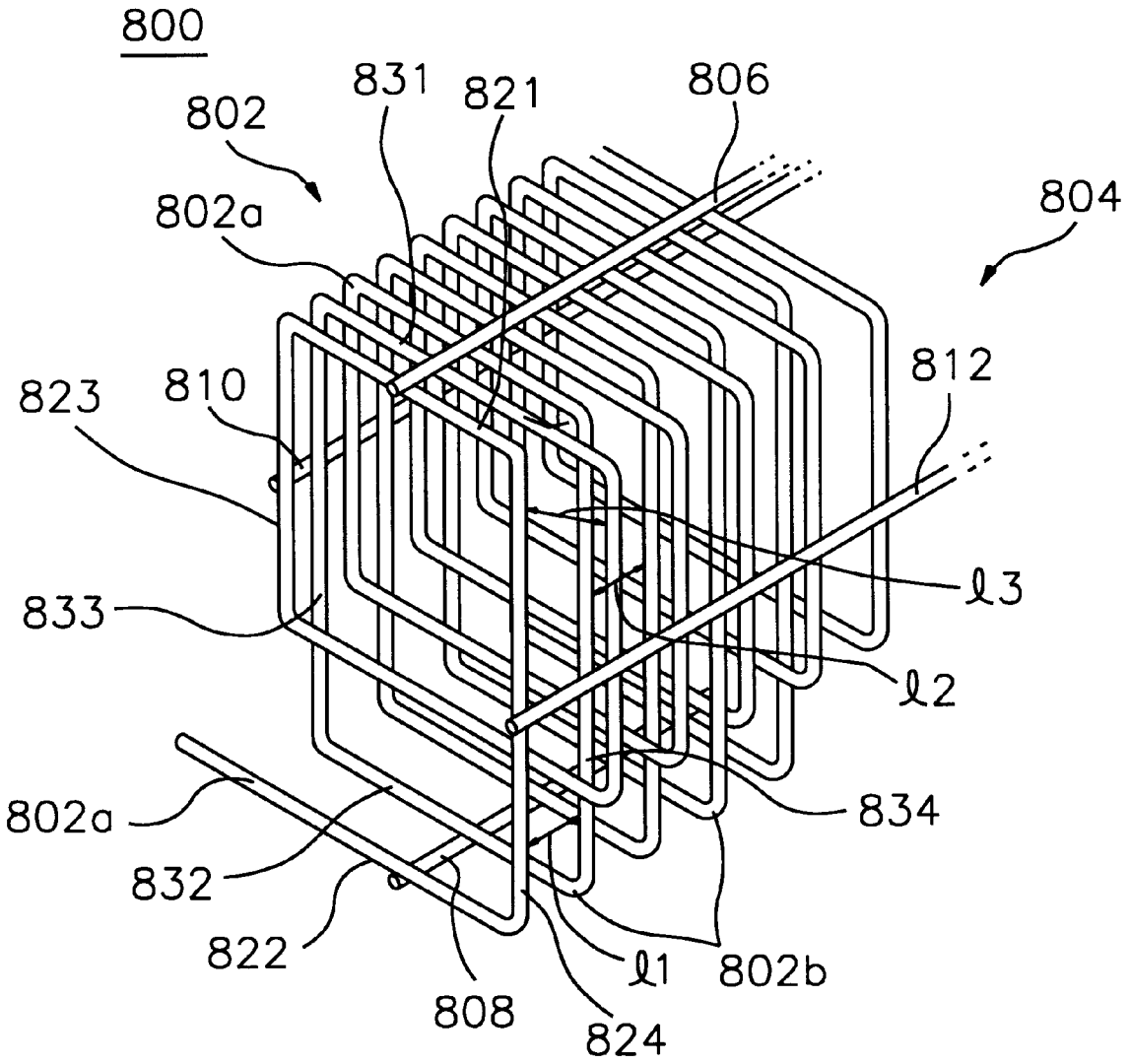
FIG. 11 is a perspective view for showing a coil-type condenser for a refrigerator according to a second embodiment of the present invention.

FIG. 11 shows a coil-type condenser 800 for a refrigerator according to a second embodiment of the present invention. The coil type condenser 800 includes a pipe 802 and a support member 804. The pipe 802 is wound spirally to face a blowing direction of cool air generated by a cooling fan 506 of the refrigerator. The pipe 802 includes a plurality of coils having odd and even numbered coils 802*a* and 802*b* formed integrally.

Each of the odd numbered coils 802*a* has upper and lower horizontal portions 821 and 822 and left and right vertical portions 823 and 824. Each of the even numbered coils 802*b* has upper and lower horizontal portions 831 and 832 and left and right vertical portions 833 and 834. Each of even numbered coils 802*b* has a size different from that of each of odd numbered coils 802*a*. Each coil of the pipe 802 preferably has a rectangular shape. Lengths of the upper and lower horizontal portions of each of the odd numbered coils are preferably different from those of the upper and lower horizontal portions of each of the even numbered coils. Lengths of the left and right vertical portions of each of the odd numbered coils are preferably different from those of the left and right portions of each of the even numbered coils.

A pitch l1 between the odd numbered coils 802*a* is preferably 8~12 mm, more preferably 10 mm. As same as in the odd numbered coils 802*a*, a pitch l2 between the even numbered coils 602*b* is preferably 8~12 mm, more preferably 10 mm. A pitch l3 between one of the odd numbered coils 802*a* and one of the even numbered coils 802*b* is preferably 8~12 mm, more preferably 10 mm.

The support member 804 is welded to the pipe 802 and supports the pipe 802. The support member 804 includes a first support 806, a second support 808, a third support 810, and a fourth support 812. The first support 806 is welded to the upper horizontal portions 821 and 831 of the odd and even numbered coils 802*a* and 802*b* and supports the odd and even numbered coils 802*a* and 802*b* on a first same plane. The second support 808 is welded to the lower horizontal portion 822 of the odd numbered coils 802*a* and supports the odd numbered coils 802*a* on a second same plane. The third support 810 is welded to the left vertical portion 823 of the odd numbered coils 802*a* and the left vertical portion 833 of the even numbered coils 802*b* and supports the odd and even numbered coils 802*a* and 802*b* on a third same plane. The fourth support 712 is welded to the right vertical portion 834 of the even numbered coils 802*b* and supports the even numbered coils 802*b* on a third same plane.

EMBODIMENT 3

Figure 12:
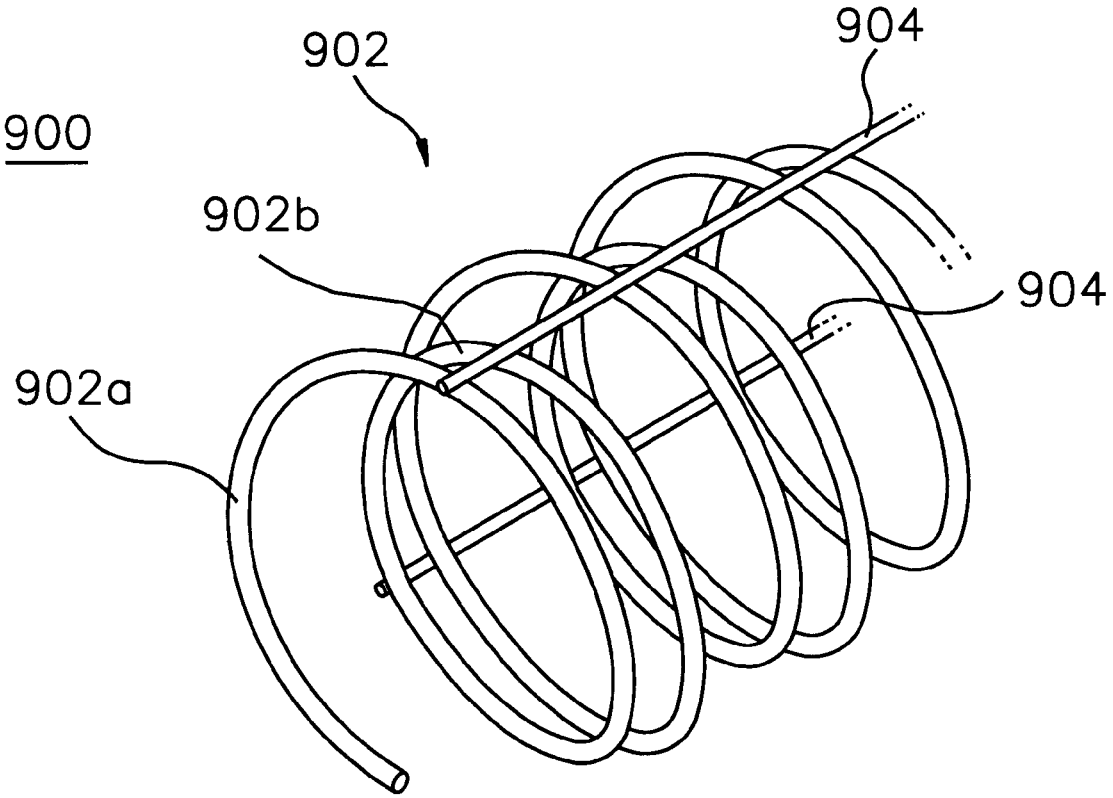
FIG. 12 is a perspective view for showing a coil-type condenser for a refrigerator according to a third embodiment of the present invention.

FIG. 12 shows the coil type condenser 900 of a refrigerator according to a third embodiment of the present invention. The coil type condenser 900 includes a pipe 902 and a support member 904.

The pipe 902 is wound spirally to face a blowing direction of cool air generated by a cooling fan of the refrigerator. The pipe includes a plurality of coils. The plurality of coils have odd numbered circle coils 902*a* arranged on a same line and even numbered circle coils 904 arranged on a line different from the odd numbered circle coils. The odd and even number circle coils 902*a* and 902*b* are integrally formed. The support member 904 is welded to the pipe 902 and supports the pipe 902 so that the odd and even numbered coils 902*a* and 902*b* are disposed on the same plane at least at one point.

As mentioned above, according to the present invention since pitches between coils of the coil type condenser become short, a suitable coil length of the condenser can be maintained in a narrow space. Thus, the coil type condenser can prevent an excessive pressure from generating when a compressor initially operates, and can be used for a small or medium refrigerator.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A condenser for refrigerator, said condenser comprising:

a pipe wound spirally to face a blowing direction of cool air generated by a cooling fan of the refrigerator, the pipe including a plurality of coils formed integrally each having upper and lower horizontal portions and left and right vertical sides, each of even numbered coils of the coils having a size different from that of each of odd numbered coils thereof; and a support member welded to the pipe for supporting the pipe, wherein the support member includes a first support welded to at least one of the upper and lower horizontal portions and left and right vertical portions of the odd and even numbered coils for supporting the odd and even numbered coils on a first same plane, a second support welded to at least one of the upper and lower horizontal portions and left and right vertical portions of the odd numbered coils for supporting the odd numbered coils on a second same plane, and a third support welded to at least one of the upper and lower horizontal portions and left and right vertical portions of the even numbered coils for supporting the even numbered coils on a third same plane.

2. A condenser for refrigerator, said condenser comprising:

a pipe wound spirally facing a blowing direction of cool air generated by a cooling fan of the refrigerator, the pipe including a plurality of coils formed integrally, the plurality of coils having odd numbered circle coils arranged on the same line and even numbered circle coils arranged on a line different from the odd numbered circle coils, the odd and even number circle coils being integrally formed; and a support member welded to the pipe for supporting the pipe so that the odd and even numbered coils are disposed on the same plane at least at one point.

* * * * *